United States Patent [19]

Groddeck et al.

[11] Patent Number: 4,961,479

[45] Date of Patent: Oct. 9, 1990

[54] DUCT FOR THE DISTRIBUTION OF LUBRICATING OIL

[75] Inventors: Michael Groddeck, Meckenbeuren; Otto Reifenscheid, Friedrichshafen, both of Fed. Rep. of Germany

[73] Assignee: MTU Friedrischshafen, Fed. Rep. of Germany

[21] Appl. No.: 427,838

[22] PCT Filed: Feb. 1, 1989

[86] PCT No.: PCT/DE89/00058

§ 371 Date: Nov. 20, 1989

§ 102(e) Date: Nov. 20, 1989

[87] PCT Pub. No.: WO89/08182

PCT Pub. Date: Sep. 8, 1989

[30] Foreign Application Priority Data

Feb. 24, 1988 [DE] Fed. Rep. of Germany ..... 3805708

[51] Int. Cl.[5] ..... F01M 1/04

[52] U.S. Cl. ..... 184/6.5; 184/6.8; 123/196 R; 123/90.33

[58] Field of Search ..... 184/6.5, 6.8, 6.17; 123/193 CH, 193 H, 195 R, 195 S, 196 R, 90.33, 90.37

[56] References Cited

U.S. PATENT DOCUMENTS 3,313,284 4/1967 Polidan ..... 184/6.8

3,855,987 12/1974 Green et al. ..... 123/196 R

FOREIGN PATENT DOCUMENTS 3703047 6/1988 Fed. Rep. of Germany .

*Primary Examiner*—Stephen F. Husar

*Assistant Examiner*—Alan B. Cariaso

*Attorney, Agent, or Firm*—Barnes & Thornburg

[57] ABSTRACT

For the distribution of lubricating oil, a duct is arranged in the crankcase 13 of a piston-operated internal-combustion engine and extends through several transverse walls 11, 12. The sections of the duct between two transverse walls 11, 12 are composed of an insert pipe 23 and of a socket pipe 24 which are constructed to be axially slidable and clampable with respect to one another. The free ends of the insert pipe 23 and of the socket pipe 24, in a sealed manner, extend in the bored transverse-wall passages 14, 15 of the duct. The arrangement results in a simplified tooling of the crankcase 13 in the area of the duct.

5 Claims, 1 Drawing Sheet

DUCT FOR THE DISTRIBUTION OF LUBRICATING OIL

BACKGROUND AND SUMMARY OF THE INVENTION

The invention relates to a duct for the distribution of lubricating oil in a piston-operated internal-combustion engine which extends in longitudinal direction of a piston-operated internal-combustion engine through several transverse walls of the crankcase, and each duct section extending between two transverse walls being constructed of axially joined components which are sealed off with respect to one another and with respect to the bored transverse-wall passages which connect in the transverse walls. The lubricating oil which was conditioned in the filter and in the oil cooler, is fed to different consumption points by way of the duct and through branch bores extending in the transverse walls.

It is known to compose the duct sections in the area between two transverse walls of the crankcase of several duct-forming structural members. Each duct section comprises two flange-type connecting pieces fastened by means of screws and each having a socket, and a pipe which can be sealingly inserted into the sockets of the two pertaining connecting parts. Sealing surfaces for the connecting parts are developed around the mouths of the transverse-wall passages.

The tooling of the sealing surfaces for the connecting parts at the transverse walls of the crankcase as well as the providing of the bores for the screwed fastening of the connecting parts, as a result of the poor accessibility of the tooling points in the crankcase, are difficult and cost-intensive operations.

It is therefore an object of the invention to achieve a simplified tooling of the crankcase in the area of the duct as a result of the construction of the components for the duct sections between the transverse walls.

According to the invention, this object is achieved by providing an arrangement characterized in that the duct section extending between two transverse walls is composed of an insert pipe and of a socket pipe which, at least partially, receives the insert pipe in a socket, in that the insert pipe and the socket pipe are constructed to be axially slidable with respect to one another, in that the free ends of the insert pipe and of the socket pipe which are axially inserted into the bored transverse-wall passages of the assigned transverse walls, at the outer circumference, each have a radial groove for receiving a sealing ring, and in that the mouth of the socket is constructed as a clamp with a tensioning device supporting itself on the insert pipe.

Further developments of the preferred embodiments of the invention are characterized by the following features:

(i) at least one breakthrough is arranged axially adjacent to the clamp developed at the mouth in the wall of the socket;

(ii) two adjacent radial grooves are developed at the outer circumference in the center part of the insert pipe which are situated in an axial assignment to the breakthrough in the wall of the socket and to the tensioning device of the clamp;

(iii) the tensioning device of the clamp, in the mounted pulled-apart condition of the insert pipe and of the socket pipe, engages radially into one circumferential groove of the insert pipe; and (iv) the mouths of the bored transverse-wall breakthroughs are constructed with conical widenings which, in the mounted condition interacting with corresponding conical shoulders at the free ends of the insert pipe and of the socket pipe, limit the depth of insertion.

The principal advantages achieved by means of the invention are that the manufacturing costs of the crankcase are lowered, that the weight and the number of components of a duct section to be mounted between two transverse walls are reduced, that low manufacturing costs are obtained for the socket pipe and for the insert pipe, and that the mounting and dismounting of the components of the duct section may carried out in a fast and simple manner.

An embodiment of the invention is shown in the drawing and will be described in detail in the following.

BRIEF DESCRIPTIONS OF THE DRAWINGS

FIG. 1 is a partial longitudinal sectional view of a crankcase in the area of the duct with mounted duct-forming components according to Line I—I in FIG. 2;

FIG. 1A schematically depicts a shortened condition of the duct-forming components which facilitate installation thereof;

DETAILED DESCRIPTION OF THE DRAWINGS

Figure 1:
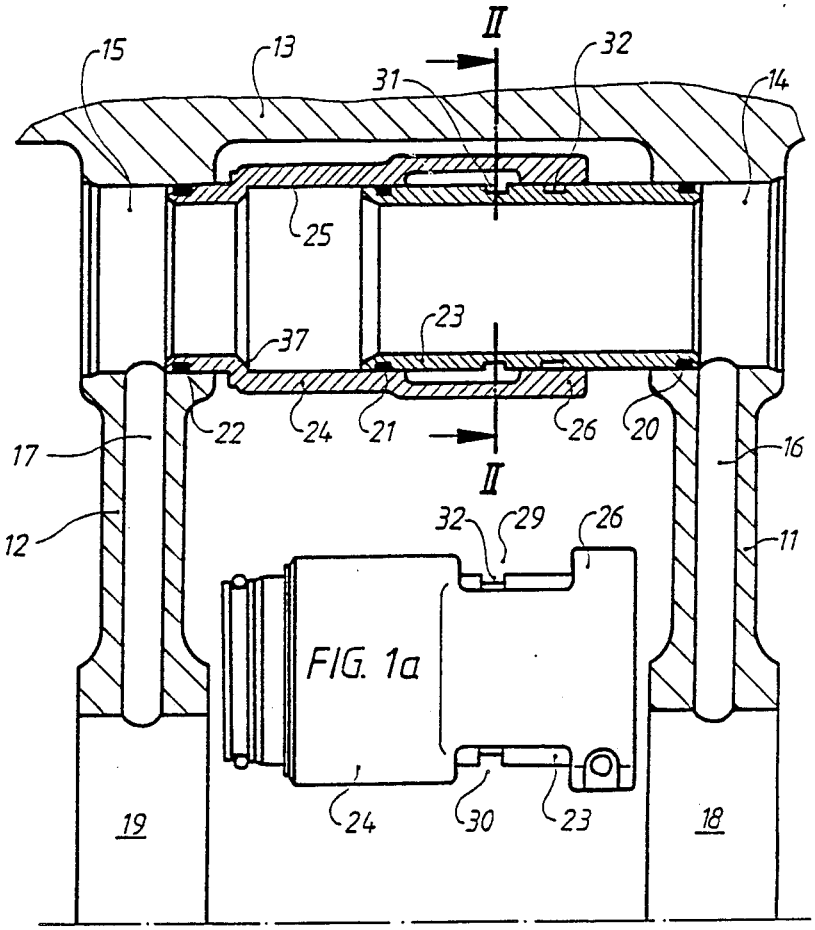

A duct, which is used for the distribution of lubricating oil, extends in longitudinal direction of a piston-operated internal-combustion engine through several transverse walls 11, 12 of the only partially shown crankcase 13. The transverse-wall passages 14, 15 of the duct are constructed as bores, from which branch bores 16, 17 branch off which feed the lubricating oil to different consumption points, such as the crankshaft bearings 18, 19. Between the transverse walls 11, 12, the duct is formed by two axially joined components which are sealed off with respect to one another and with respect to the transverse-wall passages 14, 15.

The duct-forming components parts inserted between the transverse walls 11, 12 consist of an insert pipe 23 and of a socket pipe 24 which receives the insert pipe 23 in a socket 25. In the installed condition, these pipes can be axially slid with respect to one another. The mouth of the socket 25 is constructed as a clamp 26 which is radially slotted on one side and which has a screw as the tensioning device 27. At the free ends of the insert pipe 23 and of the socket pipe 24 as well as at the end of the insert pipe 23 which is inserted in the socket 25, one radial groove respectively is arranged at the outer circumference for receiving a sealing ring 20, 21, 22. Advantageously, the three radial grooves have the same dimensions so that only one sealing ring size is required.

Axially adjacently to the clamp 26 situated at the mouth of the socket 25, the wall 28 of the socket 25 is provided with two diametrically opposite breakthroughs 29, 30. In addition, two adjacent circumferential grooves 31, 32 are developed on the outer circumference in the center part of the insert pipe 23, these circumferential grooves being situated in an axial assignment to the breakthroughs 29, 30 in the wall 28 of the socket 25 and to the tensioning device 27 of the clamp 26.

During the installation, the insert pipe 23 is pushed into the socket pipe 24 until it comes to rest against the base 37 of the socket 25. As a result, the overall length of the joined parts is shortened to such an extent that they may be inserted between the transverse walls 11, 12 with axial play (see FIG. 1*a*). As soon as the insert pipe 23 and the socket pipe 24 are aligned with the bored transverse-wall passages 14, 15, the insert pipe 23 is pushed out of the socket 25 by means of a tool, which supports itself through the breakthroughs 29, 30 in the visible circumferential groove 32 and at the face of the clamp 26. In this case, the free ends of the insert pipe 23 and of the socket pipe 24 with the mounted sealing rings 20, 22 are pushed into the bored transverse-wall passages 14, 15 of the duct. In order to facilitate the inserting of the sealing rings 20, 22, into the transverse-wall passages 14, 15, their mouths have a conical widening 33 on both sides.

Figure 4:
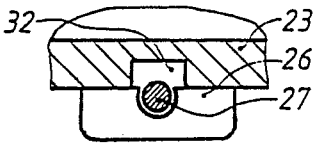
FIG. 4 is a view of a detail of the clamp according to Line IV—IV in FIG. 2.
Figure 2:
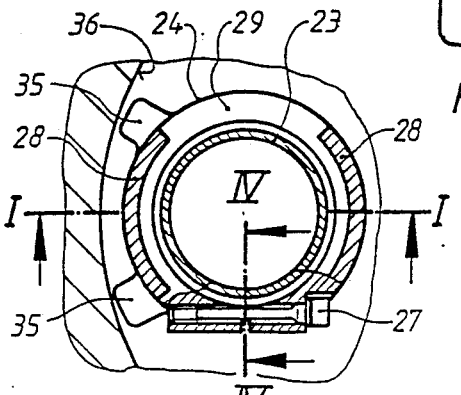
FIG. 2 is a sectional view of the duct-forming components according to Line II—II in FIG. 1.
Figure 3:
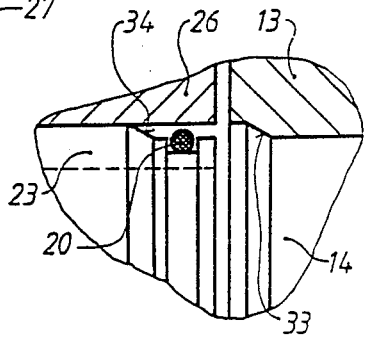
FIG. 3 is a view of a detail in the transition area between the transverse-wall passages and the duct-forming components during the installation.

After the first sliding stroke of the insert pipe 23, the circumferential groove 32 reaches the edge of the breakthroughs 29, 30 in the area of the clamp 26. The tool is then shifted, so that it now supports itself in the second adjacent circumferential groove 31 which has become accessible in the breakthroughs 29, 30. The second sliding stroke of the insert pipe 23 is completed when the conical shoulders 34 developed at the free ends of the insert pipe 23 and of the socket pipe 24 are, at a narrow distance, opposite the conical widenings 33 of the transverse-wall passages 14, 15. In this position of the insert pipe 23 and of the socket pipe 24, the screw can be screwed into the clamp 26 and can be tightened. As a result, the clamp 26 is clamped on the insert pipe 23 so that there is no longer any axial slidability between the insert pipe 23 and the socket pipe 24. The radial distance of the screw from the axis of the socket 24 is selected to be such that the screw shaft engages radially in the circumferential groove 32 (see FIG. 4). As a result, an additional securing is achieved with respect to an unintentional pushing-together of the insert pipe 23 and the socket pipe 24 if the tension of the clamp 26 were to diminish.

The conical shoulders 34 at the insert pipe 23 and the socket pipe 24, in the mounted condition, have a narrow axial distance from the conical widenings 33 of the transverse-wall passages 14, 15 which absorbs varying thermal expansions between the crankcase 13 and the duct-forming components. In addition, the conical shoulders 34 serve as an axial limit for the to-and-from motion of the mutually clamped duct-forming components resulting from the operation of the piston-operated internal-combustion engine.

Two radially projecting cams 35 are developed at the outer circumference of the socket pipe 24. In the installed condition, by placing themselves against the contour 36 of the crankcase 13, the cams 35 prevent the rotating of the insert pipe 23 and the socket pipe 24 around their joint longitudinal axis. As a result, the accessibility of the tensioning device 27 of the clamp 26 and of the breakthrough 29,30 is maintained in the installed condition, which facilitates a later required dismounting.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A duct for the distribution of lubricating oil, which extends in longitudinal direction of a piston-operated internal-combustion engine through several transverse walls of the crankcase, and each duct section extending between two transverse walls being constructed of axially joined components which are sealed off with respect to one another and with respect to the bored transverse-wall passages which connect in the transverse walls, characterized in that the duct section extending between two transverse walls is composed of an insert pipe and of a socket pipe which, at least partially, receives the insert pipe in a socket in that the insert pipe and the socket pipe are constructed to be axially slidable with respect to one another, in that the free ends of the insert pipe and of the socket pipe which are axially inserted into the bored transverse-wall passages of the assigned transverse walls, at the outer circumference, each have a radial groove for receiving a sealing ring, and in that the mouth of the socket is constructed as a clamp with a tensioning device supporting itself on the insert pipe.

2. A duct for the distribution of lubricating oil according to claim 1, characterized in that at least one breakthrough is arranged axially adjacent to the clamp developed at the mouth in the wall of the socket.

3. A duct for the distribution of lubricating oil according to claim 2, characterized in that two adjacent radial grooves are developed at the outer circumference in the center part of the insert pipe which are situated in an axial assignment to the breakthrough in the wall of the socket and to the tensioning device of the clamp.

4. A duct for the distribution of lubricating oil according to claim 3, characterized in that the tensioning device of the clamp, in the mounted pulled-apart condition of the insert pipe and of the socket pipe, engages radially into one circumferential groove of the insert pipe.

5. A duct for the distribution of lubricating oil according to claim 1, characterized in that the mounts of the bored transverse-wall breakthroughs are constructed with conical widenings which, in the mounted condition interacting with corresponding conical shoulders at the free ends of the insert pipe and of the socket pipe, limit the depth of insertion.

* * * * *